United States Patent [19]

Rubin

[11] Patent Number: 4,978,832

[45] Date of Patent: Dec. 18, 1990

[54] PRESSURIZATION OF LIQUID CARBON DIOXIDE CYLINDER

[76] Inventor: Julius Rubin, 54 Madison Ave., Franklin Square, N.Y. 11010

[21] Appl. No.: 408,113

[22] Filed: Sep. 15, 1989

[51] Int. Cl.[5] ..... H05B 3/78

[52] U.S. Cl. ..... 392/400; 392/453

[58] Field of Search ..... 219/271, 272, 273, 274, 219/275, 276, 315; 62/49.1, 45.1, 48.1; 137/403

[56] References Cited

U.S. PATENT DOCUMENTS

| | | | |
|---|---|---|---|
| 2,158,458 | 5/1939 | Mathis | 219/271 |
| 2,166,922 | 7/1939 | White | 219/272 |
| 2,348,546 | 5/1944 | Kercher | 219/273 |
| 3,053,054 | 9/1962 | Vignier | 219/271 |
| 3,346,718 | 10/1967 | Cooley | 219/275 |
| 4,608,831 | 9/1986 | Gustafson | 219/271 |

FOREIGN PATENT DOCUMENTS

| | | | |
|---|---|---|---|
| 427493 | 12/1974 | U.S.S.R. | 219/271 |

*Primary Examiner*—Teresa J. Walberg

*Attorney, Agent, or Firm*—Paul W. Garbo

[57] ABSTRACT

A positive-acting mechanism for pressurizing a liquid $CO_2$ storage cylinder involves a sealed tube suspended from the cylinder top and extending down into the bottom of the cylinder. The sealed tube contains an electric heating element and a temperature sensor connected to a thermostat. A pressure-stat with its capillary connected to the top of the cylinder is connected in electrical series with the thermostat. One wire from the heating element goes to a source of electricity and the other to the thermostat or pressure-stat. Another wire to the source of electricity is connected to the thermostat or pressure-stat whichever is not connected to the heating element.

14 Claims, 3 Drawing Sheets

PRESSURIZATION OF LIQUID CARBON DIOXIDE CYLINDER

BACKGROUND OF THE INVENTION

This invention relates to the gas pressurization of liquid carbon dioxide ($CO_2$) cylinders used, for example, by bars and soda fountains to dispense carbonated drinks.

The cylinders used in such cases are basically two metal containers, one within the other. The space between the containers acts as a thermal barrier because of insulation and a vacuum. Insulation prevents radiant heat from entering the inner container and the vacuum prevents heat convection or conduction from reaching the inner container.

As $CO_2$ gas is withdrawn from the liquid $CO_2$ storage cylinder, the gas pressure in the cylinder drops causing some liquid to turn to gas to restore the pressure in the cylinder. The gasification of liquid $CO_2$ is endothermic and, therefore, the temperature of the liquid contents of the cylinder drops. If gasification were permitted to go on continuously without heat input, solid $CO_2$ would form in the cylinder and the flow of $CO_2$ gas out of the cylinder would be minimal.

A widely used liquid $CO_2$ storage cylinder is sold under the trademark Liquidator by Taylor-Wharton Company of Harrisburg, PA. The Liquidator which is essentially representative of competitive liquid $CO_2$ storage cylinders is provided with a tube that permits the flow of liquid $CO_2$ from the bottom of the inner container and completely out of the cylinder so that the liquid can be warmed and gasified by ambient air. The resulting $CO_2$ gas is returned to the top of the cylinder to maintain the desired high pressure in the vapor space above the liquid $CO_2$ in the cylinder while $CO_2$ gas is being withdrawn for preparing carbonated beverages or other use.

The desired pressure in the cylinder is generally maintained at about 250 pounds per square inch gauge (psig). A relief valve connected to the cylinder will automatically vent $CO_2$ gas if the pressure builds up beyond the set limit and when the pressure drops a predetermined amount, liquid $CO_2$ will automatically flow out of the cylinder through the tube previously described for maintaining the desired pressure in the cylinder. During periods of large withdrawal of $CO_2$ gas for its intended use, the rapid drop in pressure may not be restored quickly enough by the flow of liquid $CO_2$ through the tube particularly if the tube is exposed to low ambient temperatures; in such case, the pressure of the $CO_2$ gas withdrawn from the cylinder may be too low for its intended use.

This serious limitation of the tube for pressure restoration is exacerbated by contaminants such as moisture and hydrocarbons (oil) in liquid $CO_2$ supplied by producers. Inasmuch as the contaminants are much less volatile than $CO_2$, their content in the cylinder keeps increasing with each new delivery of liquid $CO_2$ from the producer. Therefore, when the temperature of the liquid $CO_2$ in the cylinder drops appreciably because of a rapid pressure drop during a period of high $CO_2$ gas utilization, the contaminants will congeal and plug the tube connected to the bottom of the cylinder. Thereupon, the tube loses its pressure restoration function and the cylinder cannot dispense $CO_2$ gas at the pressure required by the user.

Accordingly, a principal object of this invention is to provide low-pressure (usually not over 300 psig), insulated cylinders for liquid $CO_2$ storage with reliable means for restoring pressure therein when $CO_2$ gas is withdrawn rapidly.

Another important object is to provide such reliable pressure restoration means that can be simply installed in such existing $CO_2$ cylinders.

Still another important object is to provide improved means for measuring the quantity of liquid $CO_2$ in storage cylinders.

Other features and advantages of the invention will be apparent from the description which follows.

SUMMARY OF THE INVENTION

In accordance with this invention, a sealed tube containing a small electric resistance heater and a temperature sensor, such as a thermocouple, near its bottom end is suspended in an insulated storage cylinder for liquid $CO_2$ from the central aperture at the top of the cylinder. The wires of the heater and the thermocouple issue from the top end of the tube that extends out of the top of the cylinder. The thermocouple wires are connected to a thermostat. One heater wire is connected to a source of electricity and the other heater wire is connected in series with the thermostat, a pressure controller (pressure-stat), and the electric source. The pressure sensor of the pressure-stat is connected to the top gas space of the storage cylinder, easily and conveniently through one of the existing ports in the collar of the cylinder. The sealed tube containing the resistance heater and thermocouple together with its associated thermostat and pressure-stat forms the positive-acting and reliable pressure-restoring means of this invention.

Thus, if $CO_2$ gas is withdrawn from the cylinder at a rapid rate, the pressure therein will drop and cause the contacts of the pressure-stat to close, permitting the flow of electricity through the normally closed contacts of the thermostat and thence to the resistance heater. Consequently, the heat from the resistance heater raises the temperature of the sealed tube, causing vaporization of the liquid $CO_2$ in contact therewith. The vaporization of liquid $CO_2$ continues until the pressure in the storage cylinder reaches a predetermined maximum as set by the pressure-stat. When the pressure in the cylinder builds up to that maximum, the pressure-stat causes the electric circuit through its pressure-responsive contacts to open and thus the flow of electricity to the heater is interrupted. As soon as the pressure in the cylinder falls below the minimum as set by the pressure-stat, the electric circuit through its contacts is again automatically closed. Generally, the minimum pressure is not more than 35 psig below the maximum pressure as controlled by the pressure-sat. Preferably, the differential between maximum and minimum pressures is about 10 to 15 psig.

The purpose and function of the thermostat are to prevent overheating of the resistance heater when there is very little or no liquid $CO_2$ in the storage cylinder. The thermostat is set to open its contacts when the temperature sensor detects a temperature at which liquid $CO_2$ cannot exist at a pressure below 300 psig. Generally, the thermostat is set to open its contacts at a temperature in the preferred range of 50° to 70° F. When liquid $CO_2$ is introduced into the storage cylinder at a pressure not exceeding about 300 psig, the temperature of the sealed tube will drop well below the temperature setting of the thermostat causing its contacts to close. However, electricity will not flow to the resistance heater until the pressure in the cylinder falls below the minimum pressure setting of the pressure-stat.

The thermocouple used to activate the thermostat may be replaced by a thermometer-type capillary containing a fluid in which case the capillary extending out of the sealed tube is connected to a thermostat of the type that is responsive to pressure variations of the fluid in the capillary.

The improved means for measuring the liquid $CO_2$ content of a storage cylinder is a platform-type weighing scale on which the cylinder is placed. Preferably, the scale involves a strain gauge connected to a readout of the digital or analog type. However, a scale of the balance or spring type may be used. In most cases, a strain gauge scale with a readout positioned near the place where $CO_2$ gas is actually dispensed is clearly advantageous and preferred because the storage cylinder is often kept in a remote and not readily accessible place.

BRIEF DESCRIPTION OF THE DRAWINGS

For a fuller understanding of the invention, the further description thereof will refer to the accompanying drawings of which.

DESCRIPTION OF PREFERRED EMBODIMENTS

Figure 1:
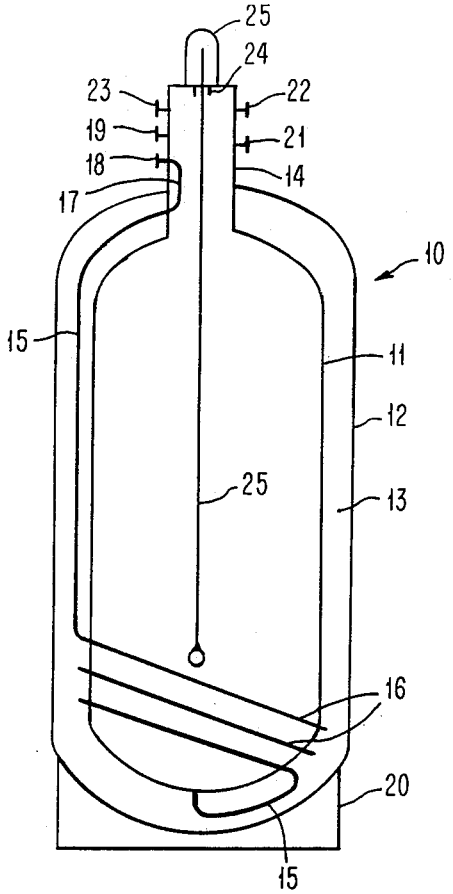
FIG. 1 PRIOR ART
FIG. 1 is a diagrammatic representation of an insulated liquid $CO_2$ storage cylinder of the prior art.

FIG. 1 illustrates the typical liquid $CO_2$ storage cylinder that is currently in wide use by bars and soda fountains. As previously mentioned, storage cylinder 10 is two cylindrical vessels 11,12, one within the other. The space 13 between vessels 11,12 is a sealed vacuum, usually filled with insulation. The top ends of vessels 11,12 are joined together in collar 14. Tube 15 connected to the bottom of vessel 11 forms coil 16 in space 13 and extends up to collar 14. Tube 15 has a short portion 17 in collar 14 connected to exit port 18 in collar 14. Pipe 17 connected to port 18 is part of the loop currently used to warm and gasify liquid $CO_2$ that reaches port 18 via tube 15. The resulting $CO_2$ gas passes from that loop back into vessel 11 through reentry port 19 in collar 14. The elements of the loop which starts at exit 18 and ends at re-entry port 19 are not shown or described because they are well known and, more importantly, are made obsolete by this invention.

To complete the description of cylinder 10 which has ring base 20 to hold it in upright position, collar 14 is shown with three other ports: fill port 21 for the introduction of liquid $CO_2$ into vessel 11, vent port 22 for the escape of $CO_2$ gas when the pressure in vessel 11 exceeds a predetermined maximum pressure, and use port 23 from which $CO_2$ gas is withdrawn for its end use. The top of collar 14 has central aperture 24 into which float gauge 25 is tightly fitted so that $CO_2$ gas does not leak out of aperture 24.

The invention makes it possible to stop using plugable tube 15 and the associated warming and gasifying loop for liquid $CO_2$ that is connected to ports 18,19. This is readily accomplished by closing a valve in the pipe connected to exit port 18. Inasmuch as storage cylinder 10 has only one central aperture 24, the only other openings that provide entry into vessel 11 being relatively small lateral ports 18,19,21,22,23, float gauge 25 must be removed so that the reliable gas pressurization means of this invention can be inserted in cylinder 10.

Figure 2:
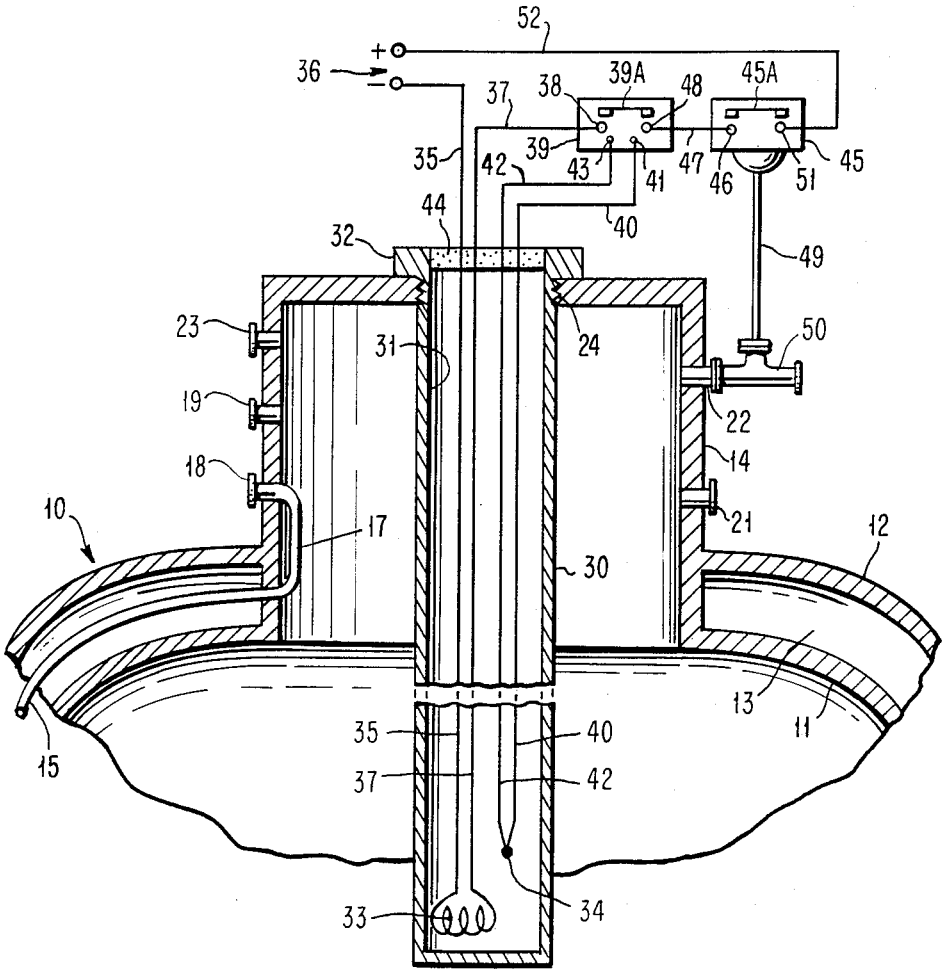
FIG. 2 is a diagrammatic representation of the novel device of the invention for pressurizing the liquid $CO_2$ storage cylinder of FIG. 1, shown mounted in the top central aperture of the cylinder.

FIG. 2 shows only the upper end of cylinder 10 and collar 14 of FIG. 1 in vertical cross-section. The float gauge 25 of FIG. 1 has in accordance with this invention been replaced by sealed tube 30 which depends from central aperture 24 in the top of collar 14 to a depth short of contacting the bottom of vessel 11. Tube 30 has threaded upper end 31 screwed into threaded aperture 24. End 31 of tube 30 also has flange 32 which provides the place for gripping tube 30 with a wrench while it is being screwed into aperture 24.

Tube 30 contains electrical heating coil 33 and thermocouple 34, both being positioned near the closed bottom end of tube 30. One wire 35 for supplying electricity to coil 33 extends therefrom up through tube 30 and out of its upper end 31 to a source of electric power 36. The other wire 37 to energize coil 33 extends up and out of tube 30 and is connected to reaction post 38 of thermostat 39. One wire 40 of thermocouple 34 passes from upper end 31 of tube 30 to one sensor post 41 of thermostat 39. The other thermocouple wire 42 is connected to the other sensor post 43 of thermostat 39. All of wires 35,37,40,42 pass through sealant plug 44 in upper end 31 of tube 30. Movable contact bar 39A of thermostat 39 normally is out of contact with posts 38,48 when the temperature sensed by thermocouple 34 is above about 50° F. as previously stated. When liquid $CO_2$ contacts sealed tube 30, the temperature drops appreciably and thermocouple 34 causes bar 39A of thermostat 39 to drop down and thus provide an electrical connection from post 38 to post 48.

The control circuit for heating coil 33 includes pressur-estat 45 with reaction post 46 thereof connected by wire 47 to reaction post 48 of thermostat 39. Capillary 49 of pressure-stat 45 communicates with the vapor space in cylinder 10 through tee-connector 50 which is attached to vent port 22 in collar 14. Ordinarily, the vent pipe for $CO_2$ gas would be connected directly to port 22 rather than to tee 50 which was inserted to provide capillary 49 with fluid access to vessel 11. The other reaction post 51 of pressure-stat 45 is connected by wire 52 to electric power source 36. Movable contact bar 45A of pressure-stat 45 is normally in contact with posts 46,51 when the pressure in vessel 11 is low, say, below 150 psig. However, electricity will not flow to resistance heater 33 while thermocouple 34 detects a temperature above about 50° F. When liquid $CO_2$ is supplied to vessel 11 the temperature sensed by thermocouple 34 drops sufficiently to cause contact bar 39A to close the connection between posts 38,48 of thermostat 39. Until the pressure in vessel 11 increases to the maximum setting, say, 300 psig, of pressure-stat 45, electricity will flow to heater 33. When the maximum pressure setting is reached, contact bar 39A springs away from posts 46,51 and the flow of elecricity to heater 33 is interrupted.

After the installation of sealed tube 30 in cylinder 10, the original loop connected to ports 18,19 for the pressurization of cylinder 10 is no longer used and, therefore, a valve in that loop is closed to prevent any flow of $CO_2$ therethrough. Typically, the maximum pressure setting of pressure-stat 45 is 250 psig and the minimum pressure setting is 215 psig. Assuming cylinder 10 has received a delivery of liquid $CO_2$ through port 21, $CO_2$ gas can be withdrawn from cylinder 10 via port 23 whenever required by the user. When the user withdraws a large quantity of $CO_2$ gas, the pressure will drop below the minimum pressure (215 psig) setting of pressure-stat 45. Thereupon, contact bar 45A will move to make the electric connection between posts 46,51 so that electricity can flow to heater 33.

The flow of electricity through coil 33 generates heat which is transmitted through metal tube 30 to liquid $CO_2$ in contact therewith. Vaporization of the liquid $CO_2$ in contact with tube 30 rapidly generates $CO_2$ gas which rises to the vapor zone in cylinder 10 to replenish the withdrawn gas and restore the desired maximum pressure of 250 psig. As soon as the pressure exceeds the maximum pressure (250 psig) setting of pressure-stat 45, capillary 49 in fluid communication with the vapor space in cylinder 10 causes pressure-stat 45 to open the electric circuit across posts 46,51. Obviously, this interruption in the circuit stops the flow of electricity to heating coil 33.

Thus, pressurization of cylinder 10 has been completed and the heating system provided by tube 30, thermostat 39 and pressure-stat 45 has turned idle. But the heating system is ready to resume its heating and pressurization function as soon as the withdrawl of $CO_2$ gas through port 23 causes the pressure in cylinder 10 to drop below the minimum pressure setting of pressure-stat 45. Thermocouple 34 automatically activates thermostat 39 to stop the flow of electricity to heating coil 33 by causing contact bar 39A to spring away from posts 38,48 when thermocouple 34 detects a temperature higher than the limiting temperature setting, say, 60° F. of thermostat 39. As previously explained, thermostat 39 functions to break the electric circuit to heater 33 only when there is insufficient liquid $CO_2$ in cylinder 10 to keep the temperature of sealed tube 30 at a low level.

Figure 3:
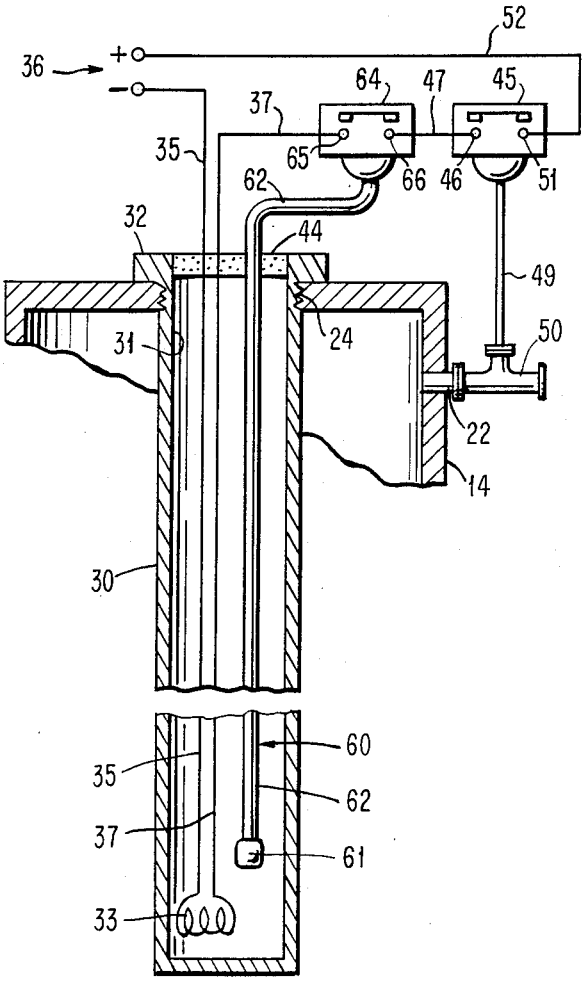
FIG. 3 is a diagrammatic representation of an alternate embodiment of the novel device shown in FIG. 2.

Sealed tube 30 and its associated thermostat 39 of FIG. 2 are shown in FIG. 3 in a different embodiment. Thermometer 60 with its fluid bulb 61 has replaced thermocouple 34 of FIG. 2. The capillary 62 of thermometer 60 passes through sealant plug 44 of tube 30 and is connected to thermostat 64 which is of the type that responds to changes in fluid pressure. Thermostat 64 differs from thermostat 39 only in the input or activation mechanism. Hence, the electrical circuit through heating coil 33, across reaction posts 65,66 of thermostat 64, through wire 47 and across reaction posts 46, 51 of pressure-stat 45 remains unchanged. Of course, the heating and pressurization on function of sealed tube 30 also remains as described for FIG. 2.

Figure 4:
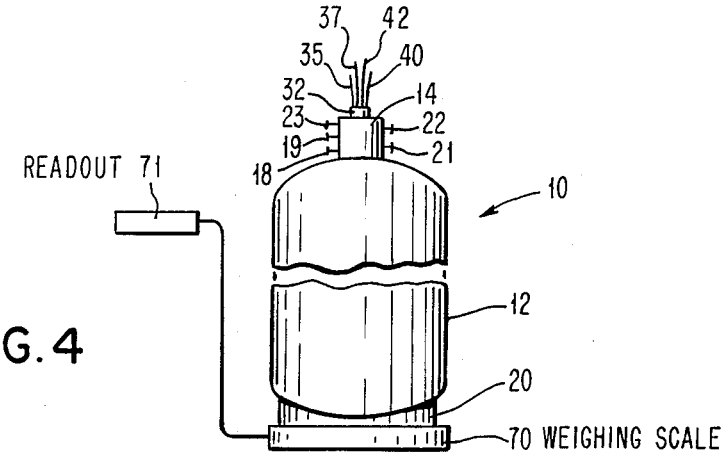
FIG. 4 is a diagrammatic representation of the cylinder of FIG. 2 standing on a weighing scale.

Inasmuch as sealed tube 30 has displaced the conventional float gauge 25 in cylinder 10 of FIG. 1, the invention provides more convenient and accurate means for measuring the quantity of liquid $CO_2$ in cylinder 10. FIG. 4 shows storage cylinder 10 of FIG. 2, or as modified by FIG. 3, positioned on weighing scale 70. While scale 70 may be in any of its known varieties, scale 70 operating on a strain gauge and having a digital readout 71 is preferred. Not only is a weighing scale more accurate than the float gauge that is in current use, but also strain gauge scale 70 provides the unique advantage that readout 71 may be placed very close to the point where $CO_2$ gas is being consumed. This is an important advantage because in many cases cylinder 10 is not in the same room where $CO_2$ gas is dispensed. With readout 71 near the point of use, the former chore of monitoring the liquid $CO_2$ content of cylinder 10 becomes as casual as looking at a wristwatch.

The foregoing disclosure has emphasized how existing storage cylinders for liquid $CO_2$ can be made more reliable in dispensing $CO_2$ gas by adding sealed tube 30 and associated thermostat 39 or 64 and pressure-stat 45 to take over the function of obsolete tube 15 and coil 16 connected to the bottom of inner vessel 11 in FIG. 1. Clearly, the production of low-pressure, insulated storage cylinders for liquid $CO_2$ can henceforth be simplified by omitting tube 15, coil 16, tube 17 and ports 18,19. This simplification will yield savings in the cost of materials and labor.

Using the previously mentioned Liquidator storage cylinder as an illustrative example of the invention, the central top opening (for standard half-inch pipe) is refitted with stainless steel tubing that is sealed at its bottom end. A Chromalox Type CIR cartridge heater ($\frac{3}{8}$-inch diameter; 600 watts capacity) supplied by Chromalox of Pittsburgh is placed in the bottom end of the sealed tube. An iron-constantan thermocouple is positioned in the sealed tube a short distance above the cartridge heater. The thermocouple wires are connected to an SO-60 thermostat sold by Selco Products Co. of Buena Park, CA; this temperature controller opens the electric circuit when the temperature rises to 60° F. The pressure-stat connected in series with the temperature controller is an L404A Pressuretrol pressure controller supplied by Honeywell of Minneapolis. The maximum pressure setting is 250 psig and the minimum pressure setting is 235 psig. When the $CO_2$ pressure in the storage cylinder drops to 235 psig the pressure controller closes the electric circuit therethrough and electricity flows to the heater. As soon as the cylinder pressure rises to 250 psig, the pressure controller opens the electric circuit and the heater is deprived of electricity until the pressure again drops to 235 psig.

As shown in FIG. 2 and FIG. 3, the thermostat and pressure-stat are connected in series by wire 47; therefore, heater wire 37 can alternatively be connected to reaction post 51 of pressure-stat 45 if wire 52 is connected to reaction post 38 of thermostat 39 in the embodiment of FIG. 2 or to reaction post 65 of thermostat 64 in FIG. 3. Other variations and modifications of the invention will be apparent to those skilled in the art without departing from the spirit and scope of the invention. For instance, instead of thermocouple 34 in FIG. 2 or thermometer 60 in FIG. 3, a thermistor sensor can be used. Similarly, mechanical thermostat 39 or 64 may be replaced by a solid state temperature controller. In lieu of screwing sealed tube 30 into central aperture 24, tube 30 may have its flange 32 bolted or even welded to the top of collar 14. Accordingly, only such limitations should be imposed on the scope of the invention as are set forth in the appended claims.

What is claimed is:

1. In a low-pressure, insulated cylinder for the storage of liquid carbon dioxide, the top of said cylinder being joined to a collar with a closed top having a central aperture, the improvement of a mechanism for maintaining the pressure in said cylinder in a predetermined range, which comprises a tube with a sealed bottom end positioned near the bottom of said cylinder, the top end end of said tube being fastened to said central aperture, an electric heating element positioned in said tube near said sealed end, two heater wires connected to said element extending out of said top end, a temperature sensor positioned in said tube slightly spaced from said element and extending out of said top end to a thermostat of the type that opens the electric circuit therethrough when said temperature sensor detects a predetermined maximum temperature, a pressure-stat having a capillary sensor and being of the type that closes the electric circuit therethrough when the pressure in said cylinder drops to a predetermined minimum and opens said electric circuit when the pressure in said cylinder rises to a predetermined maximum, said capillary sensor being connected to said collar, said pressure-stat and said thermostat being connected in series through a first reaction post of each, one of said heater wires being connected to a source of electricity, the other of said heater wires being connected to a second reaction post of said pressure-stat or said thermostat, and a wire from said source of electricity connected to the second reaction post of said pressure-stat or said thermostat not connected to the other of said heater wires.

2. The improvement of claim 1 wherein the pressure-stat closes the electric circuit therethrough at a pressure not lower than 150 psig and opens said electric circuit at a pressure not higher than 300 psig.

3. The improvement of claim 1 wherein the thermostat opens the normally closed electric circuit therethrough at a temperature in the range of about 50° to 70° F.

4. The improvement of claim 1 wherein the temperature sensor is a thermocouple.

5. The improvement of claim 1 wherein the cylinder is set on a weighing scale.

6. The improvement of claim 1 wherein the pressure-stat closes the electric circuit therethrough at a pressure not lower than 215 psig and opens said electric circuit at a pressure not higher than 250 psig.

7. The improvement of claim 6 wherein the thermostat opens the normally closed electric circuit therethrough at a temperature in the range of about 50° to 70° F. and the cylinder is set on a weighing scale.

8. The improvement of claim 7 wherein the temperature sensor is an iron-constantan thermocouple and the weighing scale comprises a strain gauge connected to a digital readout.

9. The improvement of claim 2 wherein the thermostat opens the normally closed electric circuit therethrough at a temperature in the range of about 50° to 70° F. and the cylinder is set on a weighing scale.

10. The improvement of claim 9 wherein the difference between the minimum and maximum pressure settings of the pressure-stat is not more than about 35 psig.

11. The improvement of claim 1 wherein the cylinder is set on a weighing scale that comprises a strain gauge connected to a digital readout.

12. The improvement of claim 2 wherein the difference between the minimum and maximum pressure settings of the pressure-stat is not more than about 35 psig.

13. In the conventional low-pressure, insulated cylinder for the storage of liquid carbon dioxide, the top of said cylinder being joined to a collar with a closed top having a central aperture for a standard half-inch pipe and several lateral ports, the improvement of a mechanism for maintaining the pressure in said cylinder in the range of 150 psig to 300 psig, which comprises a tube fitted in said central aperture and having a sealed bottom end positioned near the bottom of said cylinder, an electric heating element within said tube near said sealed end, two heater wires connected to said element extending out of the top end of said tube, a temperature sensor in said tube above said element extending out of said top end to a thermostat that opens the normally closed electric circuit therethrough when said temperature sensor detects a temperature in the range of about 50° F. to 70° F., a pressure-stat having a capillary sensor connected to one of said lateral ports, said pressure-stat being one that closes the electric circuit therethrough when said capillary sensor detects a minimum pressure not lower than 150 psig and opens said electric circuit when a maximum pressure not higher than 300 psig is detected, said pressure-stat and said thermostat being connected in series through a first reaction post of each, one of said heater wires being connected to a source of electricity, the other of said heater wires being connected to a second reaction post of said pressure-stat or said thermostat, and a wire from said source of electricity connected to the second reaction post of said pressure-stat or said thermostat not connected to the other of said heater wires.

14. The improvement of claim 13 wherein the temperature sensor is a thermocouple.

* * * * *